United States Patent [19]

Jones et al.

[11] 4,003,484

[45] Jan. 18, 1977

[54] SWING MECHANISM FOR IMPLEMENT BOOM

[75] Inventors: Joel Flynn Jones; Thomas Earl Spain, both of Claremore, Okla.

[73] Assignee: Hesston Corporation, Hesston, Kans.

[22] Filed: Feb. 28, 1975

[21] Appl. No.: 554,174

[52] U.S. Cl. ..... 214/138 E; 214/151; 74/89.2

[51] Int. Cl.[2] ..... B66F 9/00

[58] Field of Search ..... 214/138 E, 138 R, 151, 214/148; 74/89.2

[56] References Cited

UNITED STATES PATENTS

| | | | |
|---|---|---|---|
| 2,903,145 | 9/1959 | Brinkel | 214/138 E |
| 3,033,380 | 5/1962 | Dorkins | 214/138 E |
| 3,752,337 | 8/1973 | Pinkham | 214/138 E |
| 3,891,104 | 6/1975 | Pilch | 214/138 E |
| 3,894,641 | 7/1975 | Pilch | 214/138 E |

FOREIGN PATENTS OR APPLICATIONS

| | | | |
|---|---|---|---|
| 224,765 | 2/1959 | Australia | 214/138 E |

*Primary Examiner*—Philip Goodman
*Assistant Examiner*—John A. Carroll
*Attorney, Agent, or Firm*—Schmidt, Johnson, Hovey & Williams

[57] ABSTRACT

The boom of an earth-working implement, such as a backhoe, is swung laterally to-and-fro through a substantial arc by mechanism that requires only a single, double-acting, fluid pressure piston and cylinder assembly. A shaft on the boom is journaled onto the frame of the implement and carries a pair of superimposed sprocket wheels that are partially wrapped in opposite directions by a pair of drive chains. The chains are anchored to opposite ends of a bar reciprocable transversely of the axis of swinging movement of the boom, and the bar is coupled with the piston and cylinder assembly such that when the latter is actuated, the bar reciprocates to wrap one of the chains about its sprocket wheel while the other is unwrapped from its sprocket wheel, thereby effecting powered swinging of the boom.

8 Claims, 4 Drawing Figures

SWING MECHANISM FOR IMPLEMENT BOOM

This invention relates to implements of the type having swingable booms such as, for example, backhoes. More particularly, it relates to swing mechanism used in conjunction with the boom of a backhoe for swinging the boom laterally to-and-fro during digging operations.

The booms of backhoes and other implements have heretofore employed swing mechanisms of various kinds for effecting the degree of lateral powered swinging necessary during operation of the implements. Such mechanisms have included, for example, a pair of fluid pressure piston and cylinder assemblies connected between the frame and boom on opposite sides of the latter and converging forwardly from the frame, one of the assemblies retracting while the other extends in order to swing the boom from side-to-side. This arrangement, however, is relatively expensive in that two hydraulic assemblies are required, and the maneuverability of the boom is rendered somewhat limited because the positioning of the hydraulic assemblies usually prevents the boom from swinging through an included angle as great as 180°. Another arrangement involves the use of a pair of hydraulic assemblies in connection with a pair of drive chains that are anchored to and are wrapped oppositely about a pair of fixed sprocket wheels on the pivot shaft fixed to the boom, but while this mechanism provides an increased degree of swinging, it is still relatively expensive because two hydraulic assemblies are required.

Other more sophisticated mechanisms have been utilized which involve hydraulic assemblies in the nature of hydraulic motors coupled with the boom on opposite sides of its pivot shaft, but these, too, are relatively expensive even though they provide the desired degree of lateral maneuverability. Even the fairly commonplace rack-and-pinion swing mechanisms utilized on many implements, while capable of providing the necessary degree of lateral swinging, are relatively expensive because although only one hydraulic piston and cylinder assembly is required for each mechanism, the fabrication and maintenance of the rack-and-pinion involves considerable expense.

Accordingly, it is one important object of the present invention to provide a new swing mechanism for implements of the type described above which is capable of providing the extensive lateral maneuverability found in the more costly and complicated mechanisms hereinabove discussed, and yet which is significantly less expensive to produce and maintain than such prior mechanisms.

More specifically, it is an important object of this invention to provide swing mechanism which requires but a single, double-acting, fluid pressure piston and cylinder assembly, as in previous rack-and-pinion mechanisms, but which, in lieu of the rack-and-pinion, substitutes a unique sliding bar in combination with a special chain and sprocket arrangement.

An additional important object of the present invention is to provide swing mechanism which not only meets the maneuverability requirements and is of reduced cost, but is also relatively compact so as to utilize as little space as possible and prevent interference with smooth operation of the implement.

Figure 1:
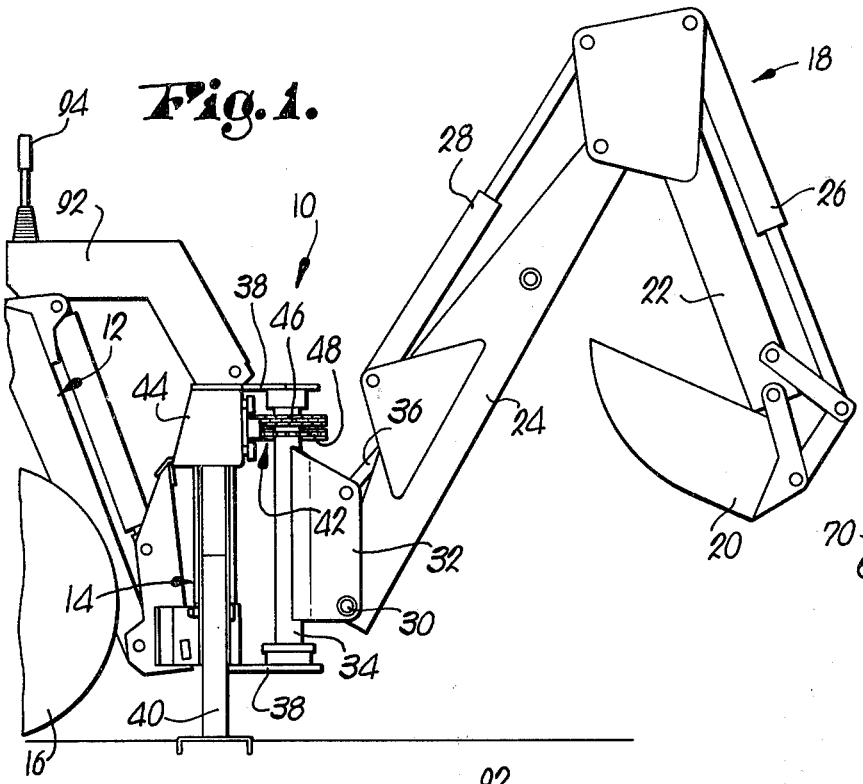
FIG. 1 is a fragmentary, side elevational view of a backhoe employing swing mechanism constructed in accordance with the principles of the present invention.
Figure 4:
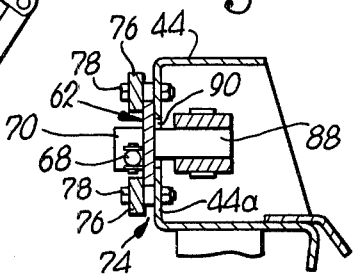
FIG. 4 is a vertical cross-sectional view through the swing mechanism and associated structure taken substantially along line 4—4 of FIG. 2.

The swing mechanism of the present invention is well-suited for use in conjunction with a number of different implements, but for purposes of illustration it has been shown in use with an attachment in the form of a backhoe 10. Further, it is to be understood that while the backhoe 10 selected for illustration is adapted for a conventional "skid-steer" vehicle, it may be adapted for many different types of vehicles such as, for example, a tractor having a three-point hitch, in which event certain minor structural modifications would exist. Such structural differences would be readily apparent to those skilled in the art and need not be herein described.

The tractor 12 on which backhoe 10 is attached supports a frame 14 in front of ground-engaging wheels 16 which in turn carries digging apparatus 18. Apparatus 18 includes a hydraulically powered shovel 20 on the outermost end of "dipper stick" 22 that is in turn swingably coupled with the outer end of a boom 24. A fluid pressure piston and cylinder assembly 26 controls manipulation of shovel 20, while another fluid pressure piston and cylinder assembly 28 controls swinging of dipper stick 22 relative to the boom 24. Boom 24 has a horizontal pivot 30 with the lower end of a bifurcated bracket 32 fixed to the pivot shaft 34 of apparatus 18, there being a partially hidden fluid pressure piston and cylinder assembly 36 between the upper end of bracket 32 and boom 24 for controlling raising and lowering of the latter about pivot 30. Shaft 34 is journaled at its upper and lower ends by a pair of forwardly extending lugs 38 on frame 14. It is also to be noted that frame 14 includes conventional outrigger type stabilizers 40 (one only being shown) for rendering the entire machine stable during digging operations.

Figure 2:
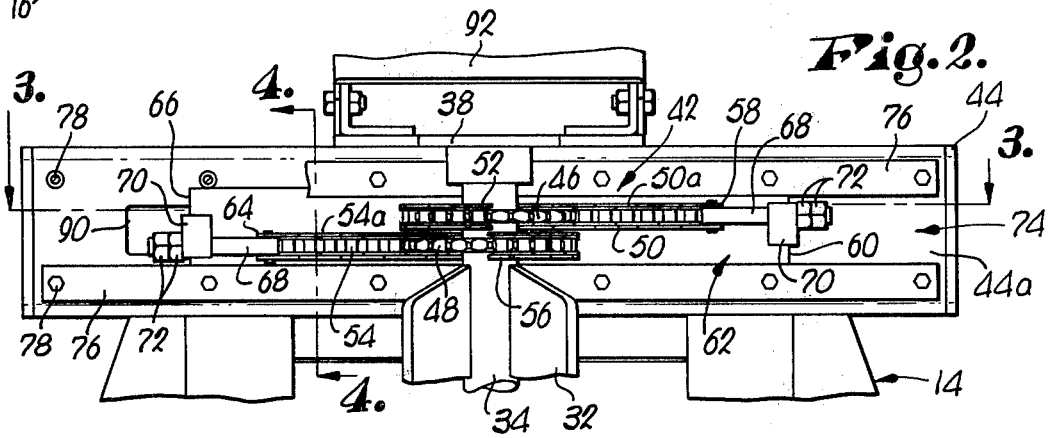
FIG. 2 is an enlarged, fragmentary, front elevational view of the swing mechanism showing the condition of the latter when the boom is centered between the opposite extremes of its lateral swinging movement.

Swing mechanism, broadly denoted by the numeral 42, operably intercouples the pivot shaft 34 with the horizontal crosshead 44 of frame 14 for controlling lateral swinging movement of boom 24 and hence apparatus 18. Swing mechanism 42 has a pair of superimposed, vertically spaced-apart sprocket wheel members 46 and 48 that are rigidly affixed to shaft 34 for rotation therewith about an upright axis. A first flexible drive element in the nature of a roller chain 50 has its first link 52 anchored to the top sprocket wheel 46 and is wrapped partially around the latter in a clockwise direction viewing FIG. 3 in driving engagement with sprockets on the periphery of wheel 46. Conversely, a second flexible drive element in the nature of a roller chain 54 has its first link 56 anchored to lower sprocket wheel 48 and is wrapped partially about the latter in a counterclockwise direction viewing FIG. 3 in driving engagement with the sprockets about the periphery of wheel 48. The last link 58 of the top drive chain 50 is anchored to one end 60 of a horizontally extending bar 62 on head 44, while the last link 64 of lower drive chain 54 is anchored to the opposite end 66 of the bar 62. Each of the anchors for the last links 58 and 64 is effected through a bolt 68 that extends through a block 70 and is retained by a pair of nuts 72. As clearly shown in FIG. 2 this arrangement of sprocket wheels 46, 48 and drive chains 50, 54 provides stretches 50*a* and 54*a* of chains 50 and 54 respectively that extend along bar 62 in opposite directions toward its opposed ends 60 and 66.

Figure 3:
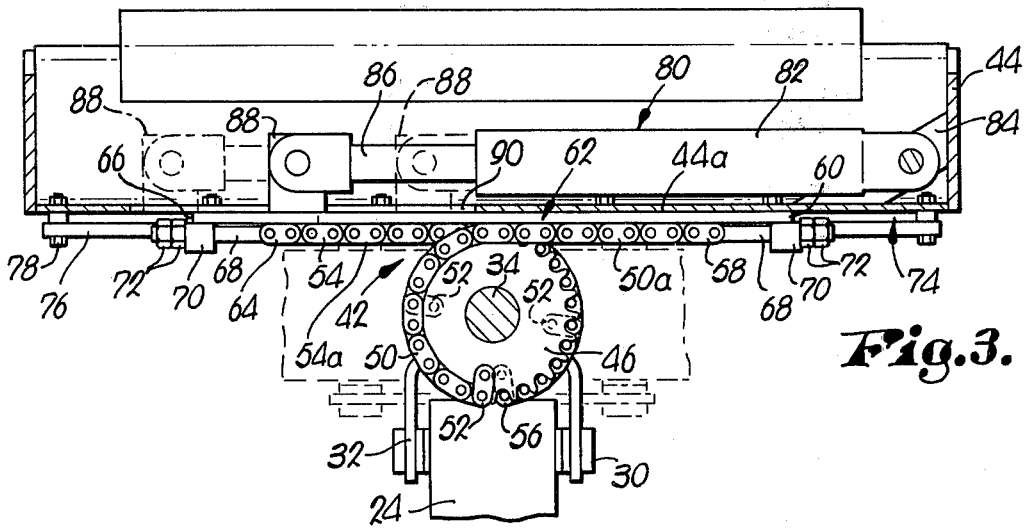
FIG. 3 is a horizontal, cross-sectional view through the swing mechanism and associated structure taken substantially along line 3—3 of FIG. 2, alternate extreme positions of the piston of the hydraulic power assembly being indicated by dashed lines.

Bar 62 is mounted on head 44 for reciprocation relative thereto along a path of travel extending transversely of shaft 34. Such reciprocable mounting is effected through a slide track 74 defined by a pair of elongated, flat guides 76 that are spaced-apart vertically from one another and are sufficiently spaced from the front side of plate 44*a* of head 44 to slidably capture the bar 62. As illustrated, the guides 76 may be mounted onto the plate 44*a* by a series of bolt and spacer assemblies 78. Power for reciprocating bar 62 is provided through a power device in the nature of a single, doubleacting, fluid pressure piston and cylinder assembly 80 that lies horizontally within head 44 behind front plate 44*a* thereof. Cylinder 82 of assembly 80 is anchored to a cross brace 84 within head 44, while the piston rod 86 of assembly 80 carries a mounting lug 88 that extends forwardly through a horizontally elongated aperture 90 in plate 44*a*. Lug 88 is in turn fixed to the bar 62 adjacent end 66 thereof such that upon extension and retraction of piston rod 86, bar 62 is reciprocated along track 74. Note as illustrated in FIG. 3 that the connection of piston rod 86 to the bar 62 is so positioned that when piston rod 86 is at the midpoint of its path of travel (as illustrated by the solid line position in FIG. 3), the midpoint of bar 62 is in line with shaft 34 to establish the latter midway between the opposite ends of the path of travel of bar 62. In this condition also, note that the sprocket wheels 46 and 48 have equal but opposite portions wrapped by their respective chains 50 and 54 and that the boom 24 is centered.

In use, the operator is normally positioned to the left of console 92 on tractor 12 and may regulate horizontal swinging of boom 24 through an appropriate control such as the operating lever 94 on console 92. Then lever 94 is moved in one direction, the piston rod 86 is extended from its solid line position in FIG. 3 to its most extended, dashed line position wherein lug 88 is disposed at the left end of aperture 90 viewing FIG. 3. Extension of piston rod 86 in this direction slides bar 62 leftwardly viewing FIGS. 2 and 3 such that lower chain 54 is pulled by bar 62 to rotate shaft 34 counterclockwise viewing FIG. 3, whereby swinging boom 24 in the same direction. Of course, during such rotation of shaft 34, stretch 54*a* and chain 54 increases in length because chain 54 is unwrapping from sprocket wheel 48 while, on the other hand, stretch 50*a* of chain 50 becomes shortened as chain 50 becomes further wrapped about its sprocket wheel 46. When the bar 62 is in its leftmost position viewing FIGS. 2 and 3, the first link 54 of top sprocket wheel 46 is in an approximate 3 o'clock position as indicated by dashed lines in FIG. 3 and boom 24 is swung approximately 90° counterclockwise from its FIG. 3 position.

When the operator shifts lever 94 in the opposite direction from that previously described, the piston rod 86 is retracted into cylinder 82 toward the fully retracted position illustrated by dashed lines in FIG. 3. Such movement causes slide bar 62 to pull on chain 50 rather than chain 54 as bar 62 moves toward the rightmost end of its path of travel, thereby unwrapping chain 50 from sprocket wheel 46, wrapping chain 54 onto sprocket wheel 48, and swinging boom 24 in a clockwise direction viewing FIG. 3. When slide bar 62 is in its extreme rightmost position viewing FIG. 3, the first link 52 of chain 50 is disposed in an approximate 9 o'clock position as shown by dashed lines in FIG. 3, and the boom 24 is disposed 90° clockwise from its position of FIG. 3.

Thus, it will be apparent that lateral swinging of boom 24, and hence apparatus 18, is accomplished through a simple actuation of the single hydraulic assembly 80 to either extend or retract the piston rod 86. Because chains 50 and 54 are wrapped in opposite directions about the sprocket wheels 46 and 48, and because they are anchored to opposite ends of the slide bar 62, movement of the slide bar 62 in one direction pulls on and unwraps the appropriate chain 50 or 54 to swing boom 24 while harmlessly wrapping the other chain 50 or 54. Shifting of slide bar 62 in the other direction causes the opposite result.

Note, therefore, that lateral swinging is accomplished with relatively non-complex machanism that is significantly less expensive than many prior swing mechanisms. Further, lateral maneuverability of boom 24 is in no way inhibited by the present arrangement because the extent of such swinging is limited only by the stroke of piston rod 86. If desired, boom 24 could be swung through a greater than 180° arc, although it is anticipated that for most operations 180° will be totally sufficient. Of further interest is the face that the swing mechanism 42 occupies little space on backhoe 10 such as to present a neat, compact arrangement and to preclude any interference with apparatus 18 during digging operations. In this regard, it is apparent that the placement of hydraulic assembly 80 horizontally within head 44, alongside of slide bar 62 is very desirable from a space-saving standpoint.

Having thus described the invention, what is claimed as new and desired to be secured by Letters Patent is:

1. In an implement having a frame and a boom journaled on the frame, mechanism for swinging said boom relative to the frame comprising:

a pair of spaced-apart members secured to said boom on its axis of swinging movement, each of said members having an outer periphery concentric with said axis;

a bar shiftably mounted on said frame for reciprocation transversely of said axis;

a first flexible drive element interconnecting the periphery of one of said members and one end of said bar;

a second flexible drive element interconnecting the periphery of the other of said members and the opposite end of said bar, said members being engaged by said elements from opposite directions; and a single, double-acting power device only between said frame and the bar for reciprocating the latter to swing the boom, said frame including an upright, apertured plate having a track for the bar on the one side thereof facing the boom, said power device located on the opposite side of said plate and being coupled with said bar through the aperture in said plate.

2. In an implement as claimed in claim 1, wherein said axis is located midway between the opposite ends of the path of travel of said bar.

3. In an implement as claimed in claim 1, wherein said power device comprises a fluid pressure piston and cylinder assembly, said aperture being elongated and extending along the path of reciprocation of the piston of the assembly.

4. In an implement as claimed in claim 3, wherein said track includes a pair of elongated, laterally spaced-apart guides, each being spaced outwardly from said one side of the plate, said bar being captured between the guides and said one side of the plate.

5. In an implement as claimed in claim 4, wherein said elements have a pair of oppositely extending sections along the bar located between said guides.

6. In an implement as claimed in claim 5, wherein each element comprises a roller chain.

7. In an implement as claimed in claim 6, wherein each member has a series of sprockets on its periphery engageable with the corresponding chain.

8. In an implement as claimed in claim 1, wherein said device comprises a fluid pressure, piston and cylinder assembly, the piston thereof being connected to said bar and the cylinder thereof being anchored to said frame.

* * * * *